US005393578A

United States Patent [19]

Yang

[11] Patent Number: 5,393,578

[45] Date of Patent: Feb. 28, 1995

[54] CHRISTMAS MOTION ORNAMENT

[76] Inventor: Steve Yang, 9F-17, No. 3, Tien Mu W. Rd., Taipei, Taiwan, Prov. of China

[21] Appl. No.: 36,602

[22] Filed: Mar. 24, 1993

[51] Int. Cl.[6] ..... A47G 33/08

[52] U.S. Cl. ..... 428/7; 40/414; 428/11

[58] Field of Search ..... 428/13, 7, 11; 40/414

[56] References Cited

U.S. PATENT DOCUMENTS

| | | | |
|---|---|---|---|
| 3,888,030 | 6/1975 | Bradt | 428/542.2 |
| 4,682,079 | 7/1987 | Sanders et al. | 428/7 X |
| 4,923,721 | 5/1990 | Gilmore | 428/11 |
| 4,989,120 | 1/1991 | Davis et al. | 428/13 X |
| 5,110,636 | 5/1992 | Hou | 428/13 X |
| 5,247,753 | 9/1993 | Yang | 40/414 |
| 5,277,948 | 1/1994 | Daun | 428/16 X |

*Primary Examiner*—Henry F. Epstein

*Attorney, Agent, or Firm*—Lowe, Price, LeBlanc & Becker

[57] ABSTRACT

Disclosed is a Christmas motion ornament which includes an AC motor set received inside a hollow, semi-spherical shell, a cover covered on the AC motor set, a rotary table decorated with animate toy ornaments and disposed above the cover and having a bottom gear meshed with a pinion on the output shaft of the AC motor set, and a fixed table decorated with inanimate toy ornaments and fixed to a pin dowel being protruded over the rotary table through a hole thereof.

3 Claims, 12 Drawing Sheets

CHRISTMAS MOTION ORNAMENT

BACKGROUND OF THE INVENTION

The present invention relates to a Christmas motion ornament which comprises a fixed table with inanimate toy ornaments disposed above a rotary table with animate toy ornaments, and an AC motor set electrically connected to the AC power supply of the Christmas light sets and controlled to rotate the ornament supported on the rotary table under the fixed table.

A variety of Christmas motion ornaments have been known, and have been appeared on the market. FIG. 12 illustrates a Christmas motion ornament according to the prior art which comprises a rotary table having a bottom gear meshed with a pinion on the output shaft of a motor, a motor cover having an elongated upright rod extended out of the rotary table through a hole thereon, decorative objects and light sets respectively mounted on the rotary table and the upright rod, and a control circuit for controlling the operation of the motor and the decorative light sets. Turning on the motor causes the pinion to drive the bottom gear in turning the rotary table on the upright rod. During the operation of the Christmas motion ornament or upon an impact force, the decorative object on the elongated upright rod may be caused to oscillate, and oscillating the elongated upright rod may cause disengagement of the bottom gear from the pinion. Therefore, this structure of Christmas motion ornament is not stable in function. Further, the control circuit is complicated. It comprises a rectifier circuit consisted of a bridge rectifier and a zener diode to convert AC power supply into DC power supply for the motor, music IC, lamp bulbs, and other electric components. Therefore, the control circuit is expensive to manufacture. When the control circuit is damaged, it is difficult to repair.

FIG. 13 illustrates another structure of prior art Christmas motion ornament which comprises a motor electrically connected to the AC power supply of the Christmas tree light assembly, and an ornament suspended from the hooked output shaft of the motor. Turning on the Christmas tree light assembly causes the motor to turn the ornament round and round. This type of motor can only carry a light ornament having a weight below 17 grams. Further, the suspension string may be tangled during the operation of the motor, thereby causing damage to the motor.

SUMMARY OF THE INVENTION

The present invention eliminates the drawbacks of the aforesaid Christmas motion ornament, The present invention uses a fixed table fastened to a pin dowel on a motor set cover and disposed above the rotary table so that the decorative objects and light sets on the fixed table are kept still while the rotary table with the decorative objects and light sets thereon are being turned under the fixed table.

DETAILED DESCRIPTION OF THE PREFERRED EMBODIMENT

Figure 1:
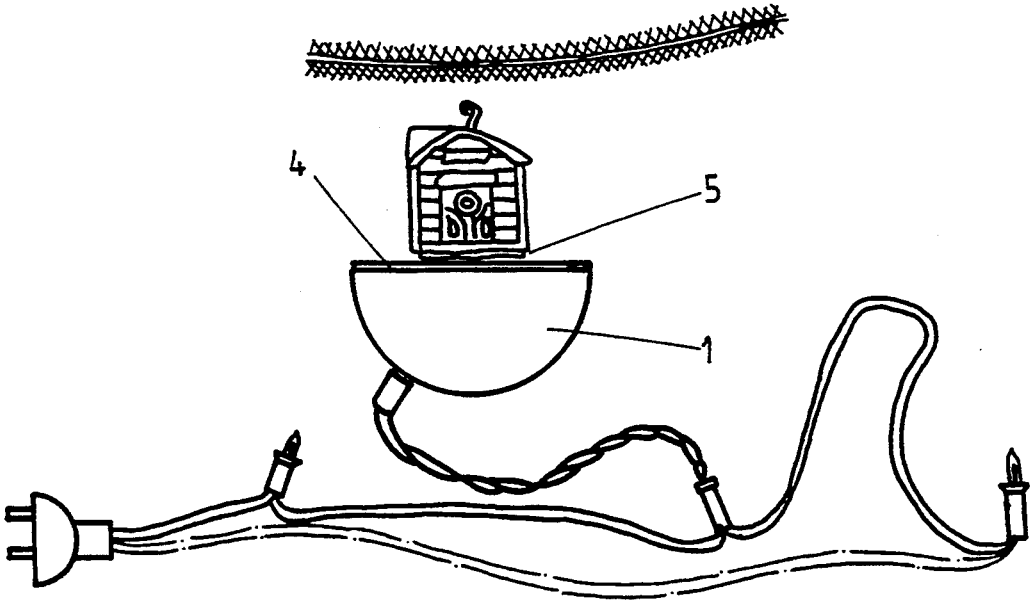
FIG. 1 is a perspective view of a Christmas motion ornament constructed according to an embodiment the present invention.
Figure 2:
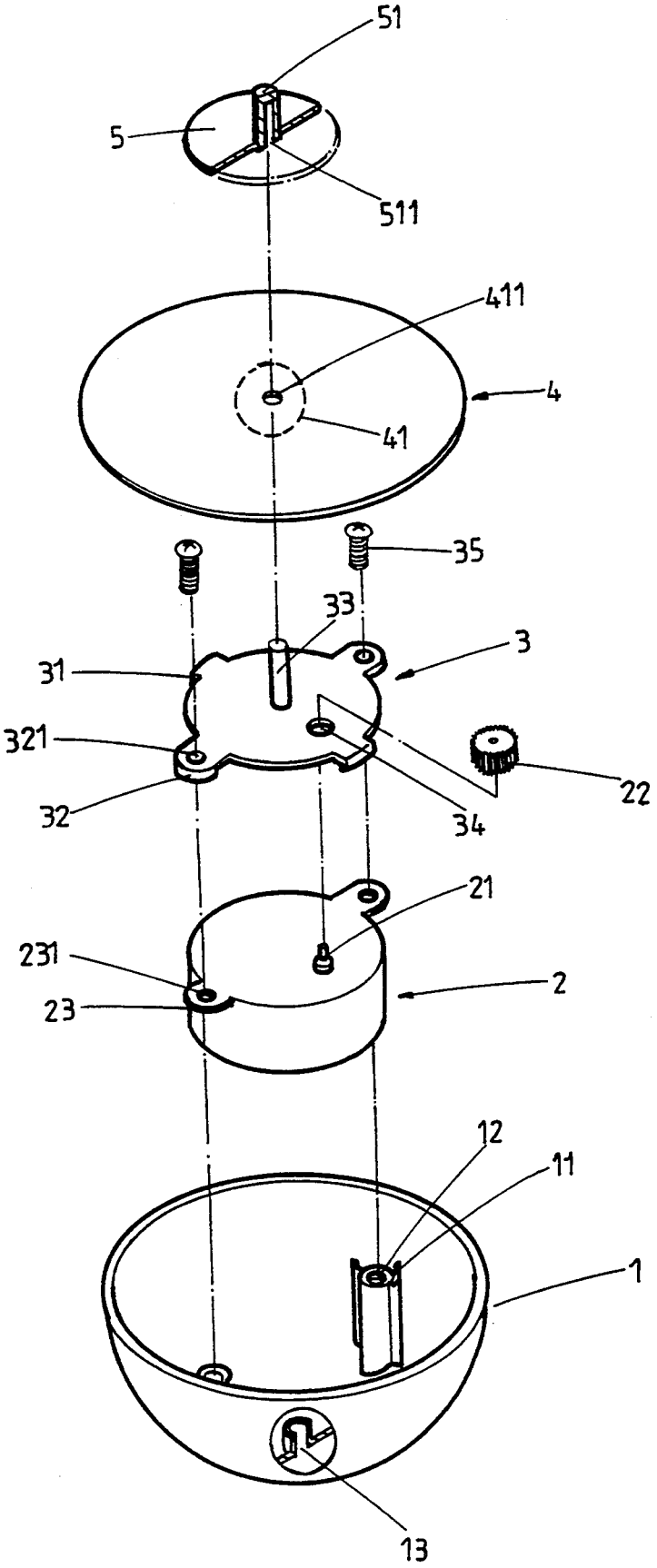
FIG. 2 is an exploded view of the mainframe of a Christmas motion ornament according to the present invention.
Figure 3:
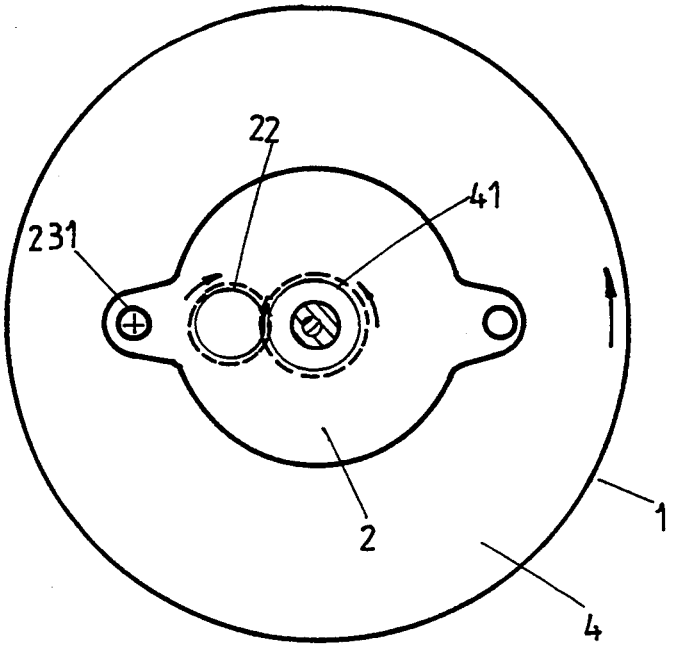
FIG. 3 is a top view of the mainframe shown in FIG. 2.
Figure 4:
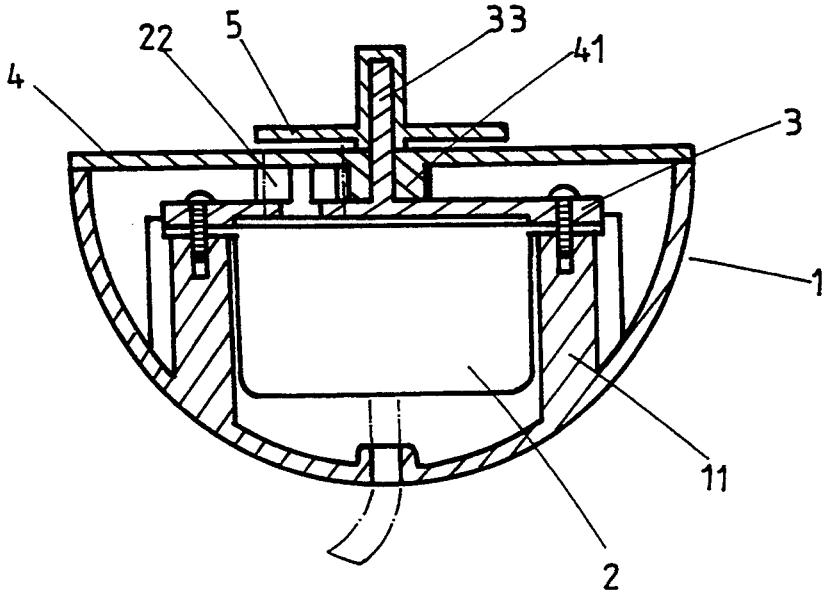
FIG. 4 is a sectional front view of the mainframe shown in FIG. 2.

Referring to FIGS. 1, 2, 3 and 4, a Christmas motion ornament constructed in accordance with the present invention comprises a mainframe consisted of a hollow, semi-spherical shell 1, an AC motor set 2, motor set cover 3, a rotary table 4, and a fixed table 5.

The shell 1 comprises two spaced mounting posts 11, which have each a screw hole 12 at the top, and a wire hole 13 through the center. The AC motor set 2 has two mounting tabs 23 with through holes 231 at two opposite locations respectively supported on the two mounting posts 11, and an output shaft 21 at an eccentric location inserted through an axle hole 34 on the motor set cover 3 and then coupled with a pinion 22 22. The motor set cover 3 has two mounting tabs 32 with through holes 321 aligned at two opposite locations respectively fastened to the mounting tabs 23 on the AC motor set 2 and the mounting posts 11 on the shell 1 by screws 35, two hooks 31 aligned at two opposite locations and respectively spaced from either mounting tab 32 through 90° angle and hooked on the peripheral edge of the AC motor set 2, and a center pin dowel 33. The rotary table 4 is supported above the motor set cover 3, comprising a driving gear 41 meshed with the pinion 22 on the output shaft 21 of the AC motor set 2 and a center hole 411 through which the center pin dowel 33 inserts. The fixed table 5 is relatively smaller than the rotary table 4 and immovably supported above the rotary table 4, having a cap 51 with a pin hole 511 into which the center pin dowel 33 fits. Turning on the AC motor set 2 causes the output shaft 21 to turn the rotary table 4 through the pinion 22 and the driving gear 41.

Figure 5:
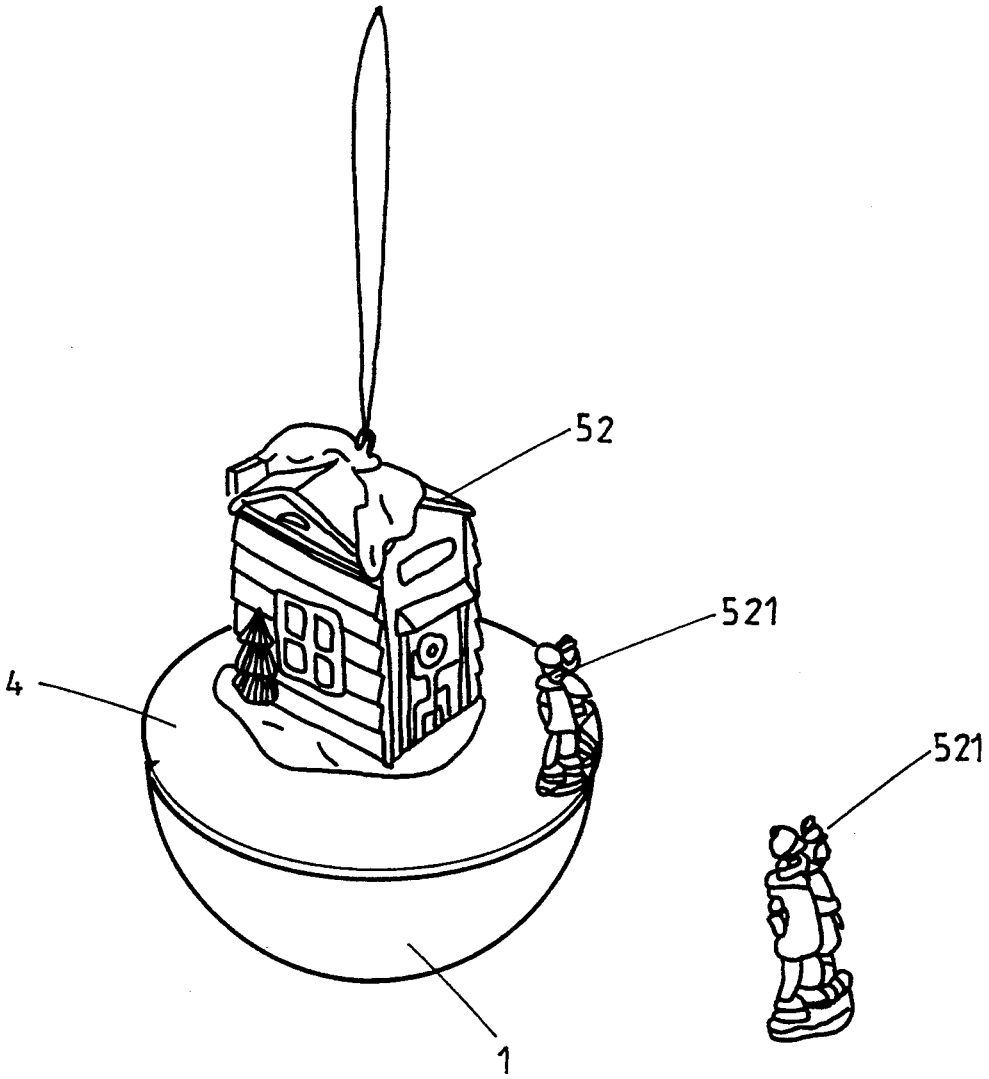
FIG. 5 illustrates an alternate form of the Christmas motion ornament of the present invention.
Figure 6:
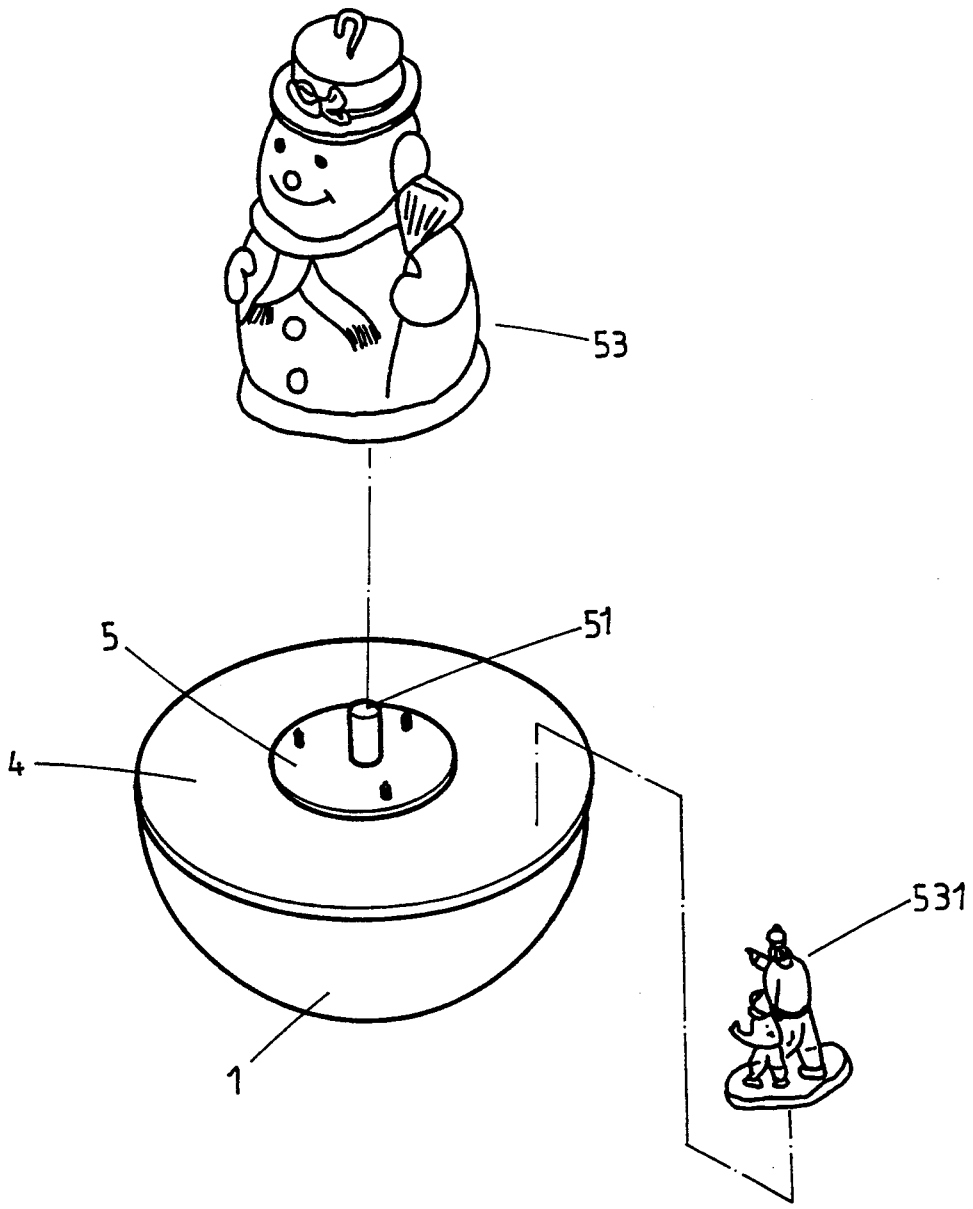
FIG. 6 illustrates another alternate form of the Christmas motion ornament of the present invention.
Figure 7:
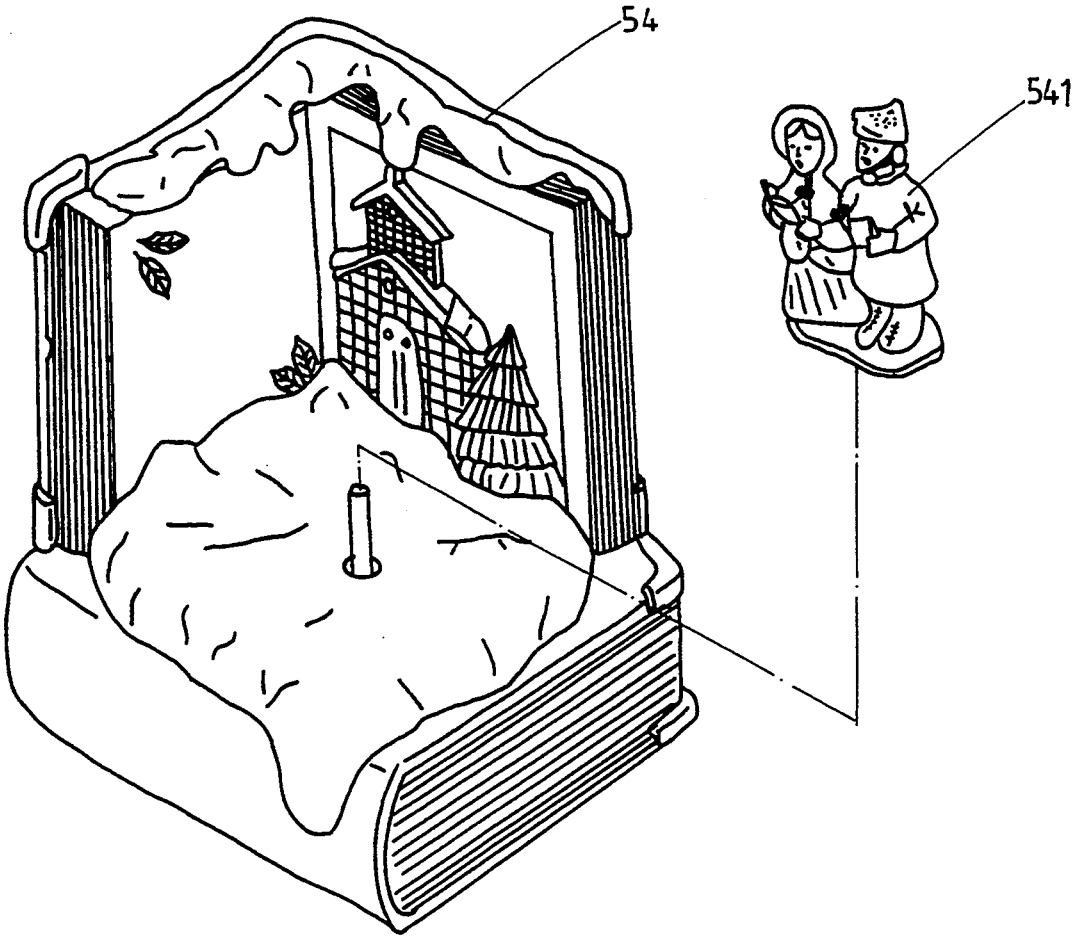
FIG. 7 illustrates still another alternate form of the Christmas motion ornament of the present invention.

Referring to FIGS. 5, 6 and 7, different ornaments simulating different inanimate objects, for example: the cottage 52 in FIG. 5, the snowman 53 in FIG. 6, and the opened book 54 in FIG. 7, and different animate objects, for example: the couple 521 in FIG. 5, the pair of children 531 in FIG. 6, and the pair of children 541 in FIG. 7, may be respectively mounted on the fixed table 5 and the rotary table 4. Therefore, the ornament of animate object 521, 531 or 541 is being continuously turned around the ornament of inanimate object 52, 53 or 54 after the motor set 2 has been turned on. These ornaments may be made from transparent materials with lamps fastened on the inside.

Figure 8:
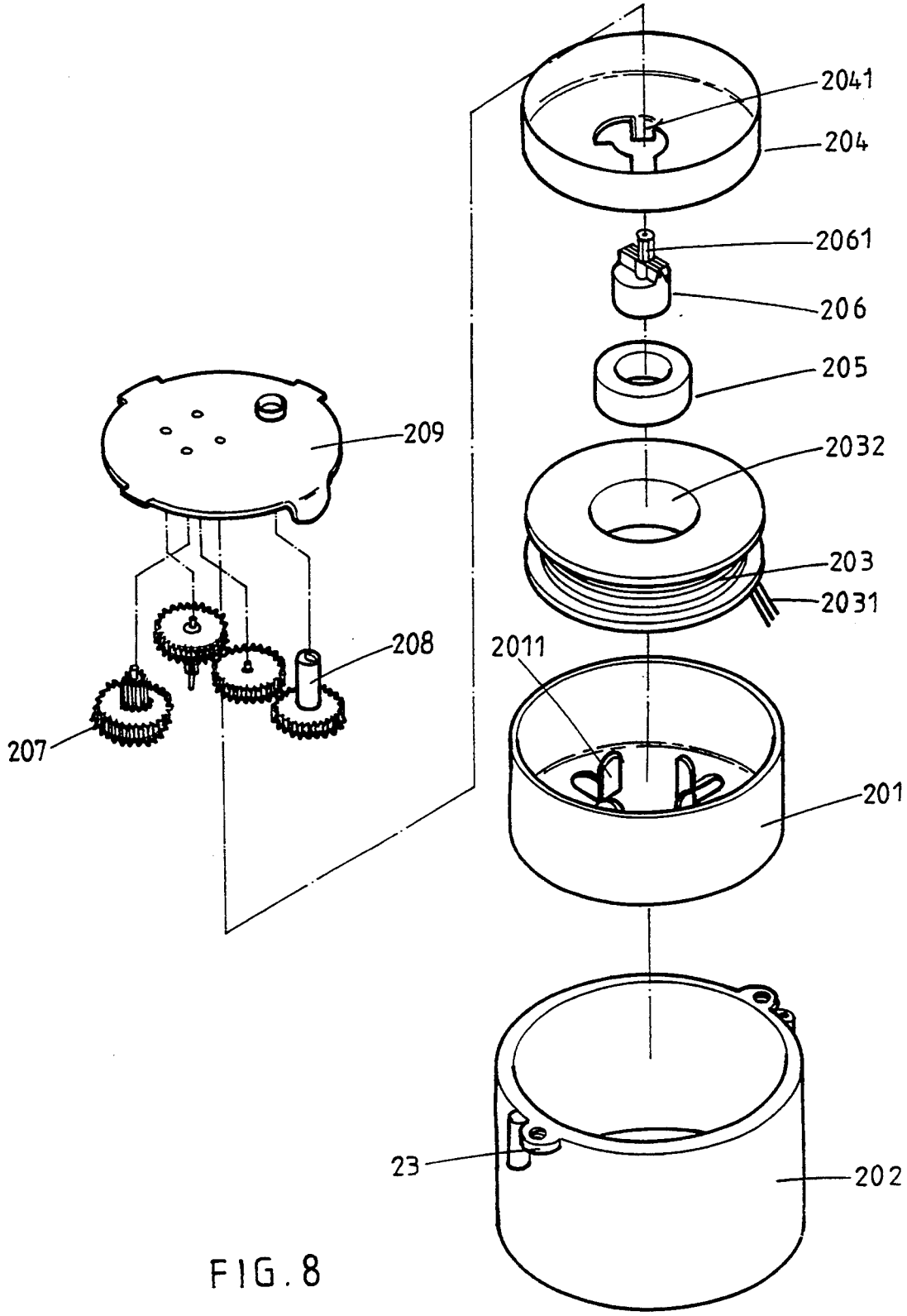
FIG. 8 is a perspective exploded view of an AC motor set according to the present invention.

Referring to FIG. 8, which shows the exploded perspective view of the aforesaid AC motor set 2, in which multiple parts of the AC motor set 2 is mounted in a metal case 201 covered with an insulated case 202. There is a coil 203 fixed in the metal case 201 to be composed of 600 to 850 turns of thicker winding. A wire 2031 extends out from the metal case and the insulated case is connected with the plug, able to be inserted in the plug socket of a string-set. At the bottom of the metal case 201 several upwardly protruding plates 2011 extending to the center hole 2032 of the coil are set; the protruding plates 2011 and the plates 2041 extending downwardly from the upper metal case 204 from six poles, also known as the outer stator of the motor, which make the coil drive a rotary magnet 205 set in the center hole 2032 after the coil is supplied with power source by the wire 2031. The magnet 205 is a permanent magnet rotor, from the middle of which a rotor spindle 206 extends upwardly and a rotor pinion 2061 engages with a reducing gear set 207. As a result, the number of the revolution of the output rotor spindle 208 set at the end of the reducing gear set can be properly regulated, and thus the rotary spindle 208 for the output power mounted at the end of the reducing gear set can be well accommodated until the output revolution are reasonably demanded for the transmission means mounted on the guard of the upper metal case 209 and the guard of the upper case 69 so that the transmission means can implement multiple-directional movement and drive the doll therefor.

Figure 9:
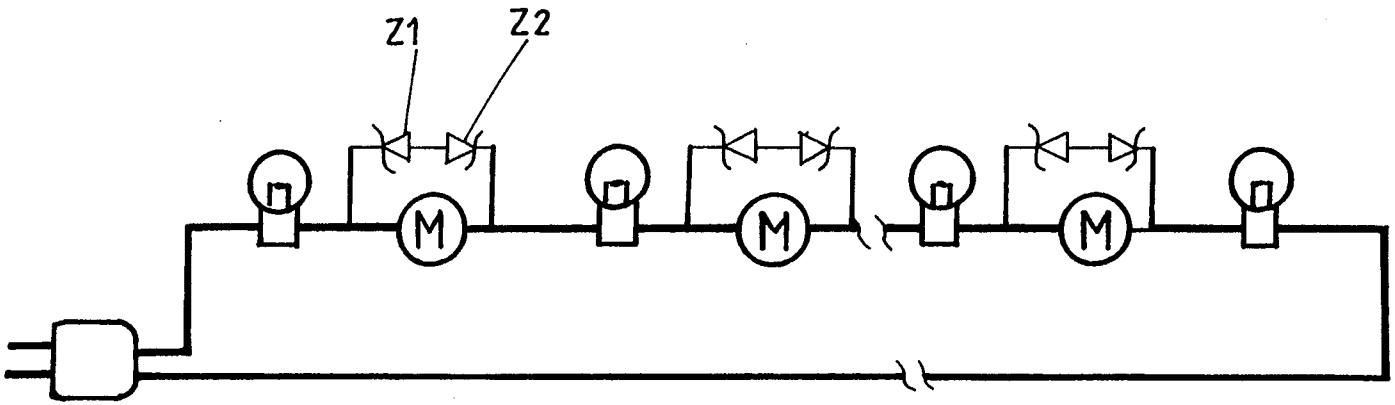
FIG. 9 is a circuit diagram for the AC motor set shown in FIG. 8.

Referring to FIG. 9, where a circuit diagram is shown, the AC motor set 2 are mounted a pair of zener diodes Z1,Z2 connected each other in reverse and connected with the AC motor in parallel so as to control constant voltage of the AC motor set 2; this means that the diodes can serve as a diverter to sustain a constant quantity of current passing through the AC motor and to release the excess current. All this is for keeping normal operation of the motor.

Figure 10:
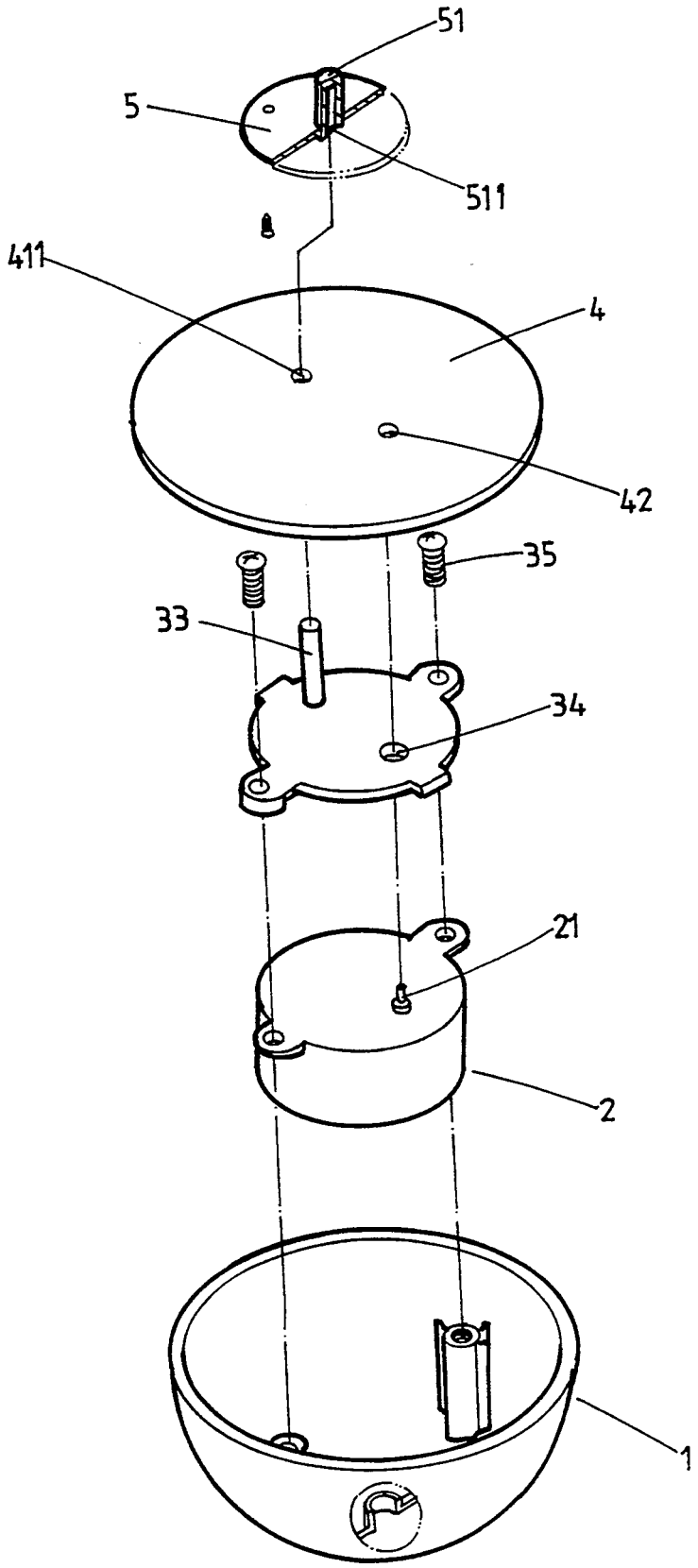
FIG. 10 is a perspective exploded view of an alternate form of the mainframe.
Figure 11:
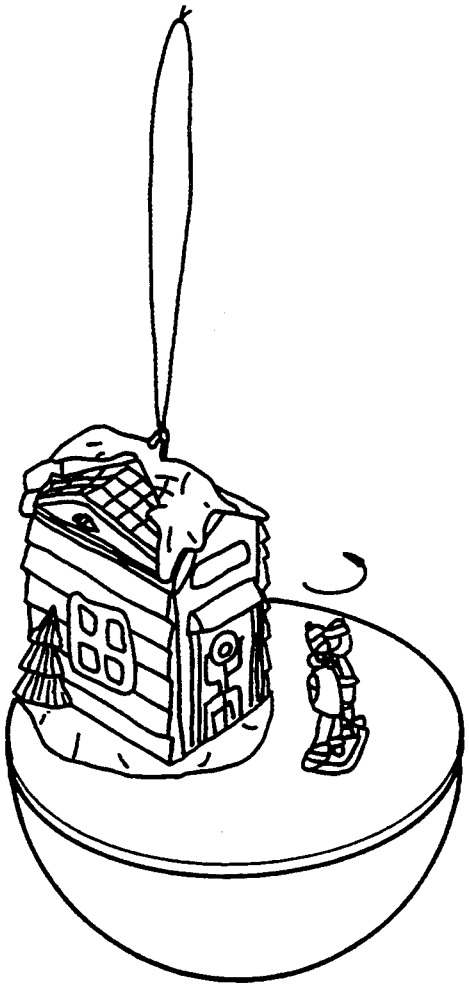
FIG. 11 is a perspective elevational view of a Christmas motion ornament having the mainframe shown in FIG. 10.
Figure 12:
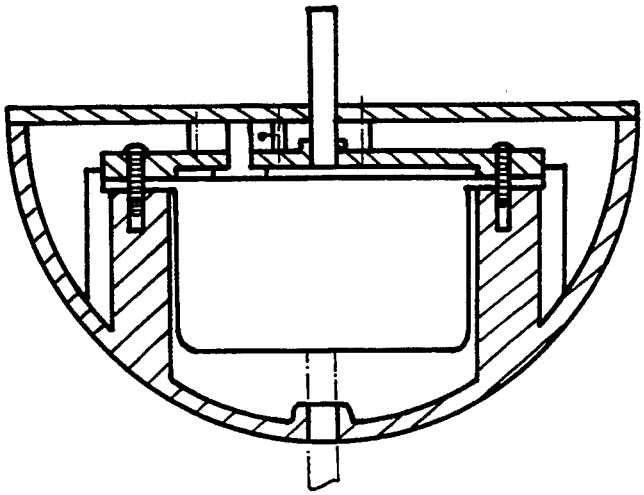
PRIOR ART FIG.12
FIG. 12 is a sectional front view of the mainframe of a prior art Christmas motion ornament.
Figure 13:
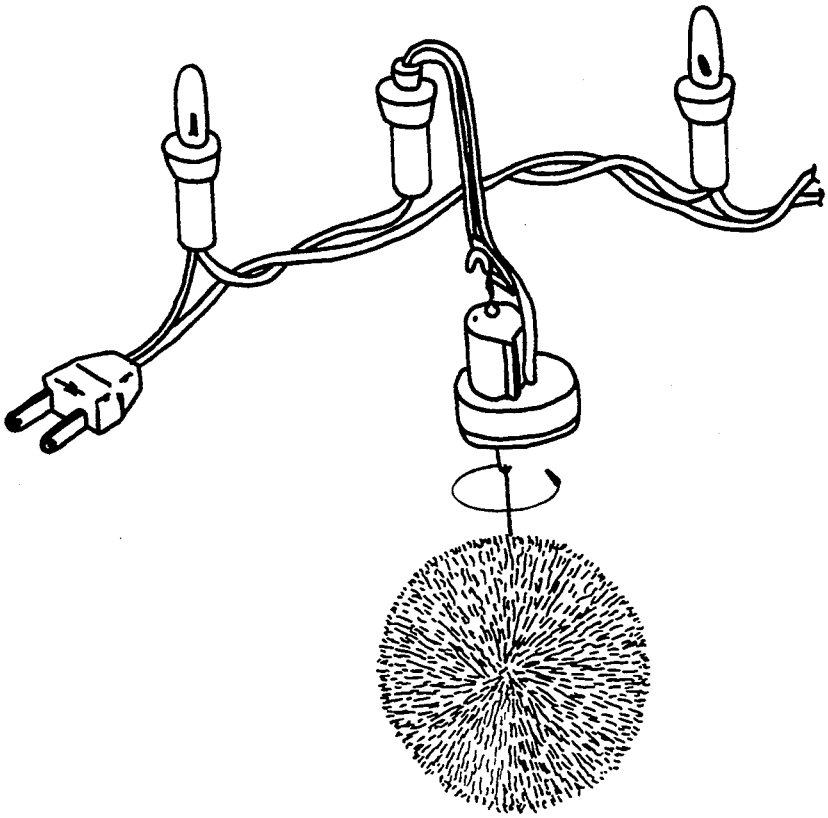
PRIOR ART FIG. 13
FIG. 13 is a perspective view of another prior art Christmas motion ornament.

Referring to FIGS. 10 and 11, therein illustrated is an alternate form of the present invention which eliminates the use of the pinion 22 on the output shaft 21 of the AC motor set 2, and the driving gear 41 on the rotary table 4. The output shaft 21 of the AC motor set 2 in this alternate form inserts through an axle hole 42 on the rotary table 4 and directly coupled to the ornament 521;531;541. Therefore, the rotary table 4 is immovable, and the ornament is turned round and round as the AC motor set 2 is turned.

What is claimed is:

1. A Christmas motion ornament comprising:

a shell and an electric wire said shell having two spaced mounting posts, each post having a screw hole at the top, and wire hole through the center receiving said electric wire said wire being adapted to be coupled to a source of alternating current;

an AC motor coupled to said wire having two mounting tabs with through holes respectively supported on the mounting posts of said shell and an output shaft extending vertically upwardly at the top thereof;

a motor set cover mounted on said AC motor set at the top thereof, said motor set cover comprising two mounting tabs with through holes respectively connected to the mounting tabs on said AC motor set and the mounting posts on said shell by screws, two hooks aligned at two opposite locations and equiangularly spaced from either mounting tab and hooked on the peripheral edge of said AC motor set to hold said motor in place, a center pin dowel extending vertically upwardly at the top, and an axle hole receiving the output shaft of said AC motor set said dowel and output shaft being mutually spaced and extending upwardly from said cover;

a pinion coupled to the output shaft of said AC motor set and disposed above said motor set cover;

a rotary table supported above said motor set cover, said rotary table comprising an integral driving gear on the lower surface thereof meshed with said pinion, and a center hole through which the center pin dowel passes; and a table fixed to the center pin dowel of said motor set cover and disposed above said rotary table, said fixed table being relatively smaller in diameter than said rotary table and comprising a cap into which the pin dowel of said motor set cover fits tightly;

whereby when coupled to a source of alternating current said AC motor set causes its output shaft to drive said pinion and rotate said rotary table relative to said fixed table via said driving gear.

2. The Christmas motion ornament of claim 1 wherein said rotary table and said fixed table are respectively decorated with ornamental objects.

3. A Christmas motion ornament comprising:

a shell and an electric wire, said shell having two spaced mounting posts, each post having a screw hole at the top, and wire hole through the center receiving said electric wire said wire being adapted to be coupled to a source of alternating current;

an AC motor set coupled to said wire and having two mounting tabs with through holes respectively supported on the mounting posts of said shell and an output shaft vertically disposed at the top and driven to turn an ornament;

a motor set cover mounted on said AC motor set at the top thereof, said motor set cover comprising two mounting tabs with through holes respectively connected to the mounting tabs on said AC motor set and the mounting posts on said shell by screws, two hooks aligned at two opposite locations and equiangularly spaced from either mounting tab and hooked on the peripheral edge of said AC motor set to hold said motor in place, a center pin dowel extending vertically upwardly at the top, and an axle hole receiving the output shaft of said AC motor set said dowel and shaft being mutually spaced and extending upwardly from said cover;

a plate top cover supported above said motor set cover, said plate top cover having an axle hole at an eccentric location through which said output shaft of said AC motor set projects, and a center hole through which the center pin dowel of said motor set cover passes;

a table fixed to the center pin dowel of said motor set cover and disposed above said plate top cover, said fixed table being relatively smaller than said plate top cover and comprising a cap mounted on the pin dowel of said motor set cover; and an ornament being smaller than said plate top cover mounted above said top cover on the end of the output shaft of said AC motor extending through the eccentric axle hole therein;

whereby when coupled to a source of alternating current said AC set causes its output shaft to rotate said ornament.

* * * * *